US006050834A

United States Patent [19]

Moody

[11] Patent Number: 6,050,834

[45] Date of Patent: Apr. 18, 2000

[54] ELECTRICAL OUTLET SPLASH PROTECTOR

[75] Inventor: Paul E. Moody, Barrington, R.I.

[73] Assignee: The United States of America as represented by the Secretary of the Navy, Washington, D.C.

[21] Appl. No.: 09/226,614

[22] Filed: Dec. 21, 1998

[51] Int. Cl.[7] ..... H01R 13/44

[52] U.S. Cl. ..... 439/139; 439/93

[58] Field of Search ..... 439/138, 139, 439/93

[56] References Cited

U.S. PATENT DOCUMENTS

| | | | |
|---|---|---|---|
| 1,271,478 | 7/1918 | Krantz | 439/139 |
| 3,173,731 | 3/1965 | Anderson . | |
| 3,990,758 | 11/1976 | Petterson . | |

*Primary Examiner*—Steven L. Stephan
*Assistant Examiner*—J. F. Duverne
*Attorney, Agent, or Firm*—Michael J. McGowan; James M. Kasischke; Prithvi C. Lall

[57] ABSTRACT

A splash protector in combination with an electrical outlet includes a shield member having a first shield portion and a second shield portion opposite to the first shield portion. A spring member is provided in connection with the first and second shield portions. An outlet cover includes an outer face with a pair of rectangular slot openings and a grounding pin opening formed therein, and an inner face having a recessed area with an outer perimeter of the recessed area encompassing at least the pair of rectangular slot openings and grounding pin opening, but less than an outer dimension of the outlet cover. A spring-supporting post is formed on the inner face of the outlet cover and projecting therefrom such that the spring member fits within facing inner sides of the first and second shield portions so that the first and second shields completely block external access to the rectangular slot openings and grounding pin opening of the outlet cover. Upon selectively actuating the spring, the shield portions are moved away from the rectangular slot openings and grounding pin opening.

16 Claims, 2 Drawing Sheets

ELECTRICAL OUTLET SPLASH PROTECTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to an apparatus which integrates safety shields into electrical outlets. More particularly, the invention relates to a safety shield for an electrical outlet such that the safety shield will entirely block the power and ground openings of an outlet to prevent the entrance of a liquid splash from entering the outlet. This will minimize susceptibility of the outlet to corrosion caused by the liquid and the possibility of electrical contacts in the outlet shorting out.

(2) Description of the Prior Art

Older electrical receptacles are designed such that they have either a single or double outlet location for receipt of an electrical plug. Two slots in the outlet are rectangular to match the shape of the electrical plug prongs and the face of the outlet is slightly tapered to guide an electric plug into the slots of the outlet. Once a plug is inserted into the outlet, the plug prongs contact with positive and negative electrical current lines which provide electrical power to the item which is connected to the outlet. These outlets are not connected to a grounding wire and therefore any short circuit in the system could result in power being transmitted through an individual using the electrical outlet.

Newer receptacle outlets are connected to a third wire which is the grounding wire. These outlets are designed with a third hole in their face plate which is connected to the grounding connection. This provides a grounding path through the electrical system in lieu of through an individual using the system, should a short circuit be present in the system. The grounding connection of a plug is circular in shape (in lieu of rectangular) and is located below, and centrally between the rectangular positive and negative prongs for an electrical plug.

In either style electrical outlet, it is possible for water or other liquids to be accidentally splashed into the slots or holes in the outlet. This situation can be costly in that it can cause the metallic components of the outlet to corrode or it could cause the electrical parts to short out causing a fire or personal injury.

A safety device is inherently built into water proof spring loaded or screw on receptacle safety covers which were developed for outside use. Such safety features are not normally included in many environments, such as a laboratory, since there is no need for them to be waterproof and they cost more. The spring loaded covers are inconvenient to hold out of the way when inserting an electrical plug into an outlet and the screw on caps would most likely be left unscrewed and provide no protection. The safety apparatus described by this invention can instead be easily utilized and will normally be transparent to an observer.

The following patents, for example, disclose receptacle covers, but do not disclose a water proof receptacle cover for completely blocking the power and ground openings of an outlet which is easy to use and includes a simple spring biased safety shield.

U.S. Pat. No. 3,173,731 to Anderson; and

U.S. Pat. No. 3,990,758 to Petterson

Specifically, the patent to Anderson discloses an electrical outlet covering having two pivotal members that are pivotally positioned over a three prong electrical outlet. The purpose of the outlet covering in Anderson is to prevent insertion of a non-grounded plug into the electrical outlet. Accordingly, each pivotal member has a portion which covers only a part of the grounding pin opening and portion which covers only a part of a prong slot opening. Covering of the prong slot openings and grounding pin opening is only to the extent necessary to prevent insertion of an ungrounded plug. The pivoting member is pivotally attached between the two pivotable arms. The pivoting members swing from a closed position in which the grounding pin opening and the prong slots are partially covered to an open position in which the grounding pin opening and prong slots are completely uncovered. Anderson teaches the use of a "spring member" to provide biasing between the pivotable arms and the spring member is independent of a pivot point between the two arms. Helical compression springs and helical torsion springs are specifically disclosed.

The patent to Petterson discloses a flat spring to bias prong slot covers inside an electrical outlet.

It should be understood that the present invention would in fact enhance the functionality of the above patents by providing complete coverage of both the prong openings and the grounding pin opening in an electrical outlet, thereby achieving total closure of the outlet. The outlet would, therefore, be sealed against the intrusion of liquid or harmful substances which could corrode and/or damage the interior of the electrical outlet. The present invention would also be more reliable and compact because it uses a flat spring rather than a helical spring.

SUMMARY OF THE INVENTION

Therefore it is an object of this invention to provide an apparatus which integrates safety shields into an electrical outlet such that they will prevent water or other liquids from splashing into the prong openings or grounding pin opening of an electrical outlet.

Another object of this invention is to provide a splash protector for an electrical outlet which completely covers the prong openings and grounding pin opening of the electrical outlet.

Still another object of this invention is to provide a splash protector for an electrical outlet which has the additional feature that the shield portions of the safety shield are automatically cammed out of the way when a plug with a standard grounding pin is inserted into the grounding aperture of the outlet.

A still further object of the invention is to provide an override pin which may be used in place of the grounding pin of a plug to cam the safety shield away from the prong openings and the grounding pin opening of an electrical outlet.

Yet another object of this invention is to provide a splash protector for an electrical outlet which is simple to manufacture and easy to use.

In accordance with one aspect of this invention, there is provided a splash protector in combination with an electrical outlet. The splash protector includes a shield member having a first shield portion and a second shield portion opposite to the first shield portion. A spring member is provided in connection with the first and second shield portions. An outlet cover includes an outer face with a pair of rectangular slot openings and a grounding pin opening formed therein, and an inner face having a recessed area with an outer perimeter of the recessed area encompassing at least the pair of rectangular slot openings and grounding pin opening, but less than an outer dimension of the outlet cover. A spring-supporting post is formed on the inner face of the outlet cover and projecting therefrom such that the spring member fits within facing inner sides of the first and second shield portions so that the first and second shields completely block external access to the rectangular slot openings and grounding pin opening of the outlet cover. Upon selectively actuating the spring, the shield portions are moved away from the rectangular slot openings and grounding pin opening.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 4:
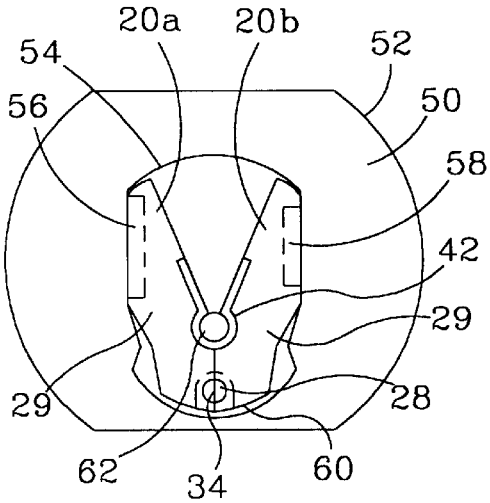
FIG. 4 is a view of a combined safety shield and spring in an electrical outlet.
Figure 5:
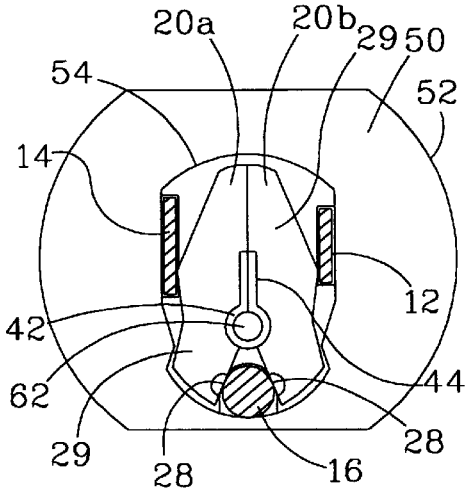
FIG. 5 is a view of the combined safety shield and spring in an electrical outlet with a three-prong plug inserted into the electrical outlet.

In general, the present invention is directed to an electrical outlet splash protector, generally shown in FIGS. 4 and 5 as it is attached to an electrical outlet. Details thereof will be set forth in the following.

Figure 1A:
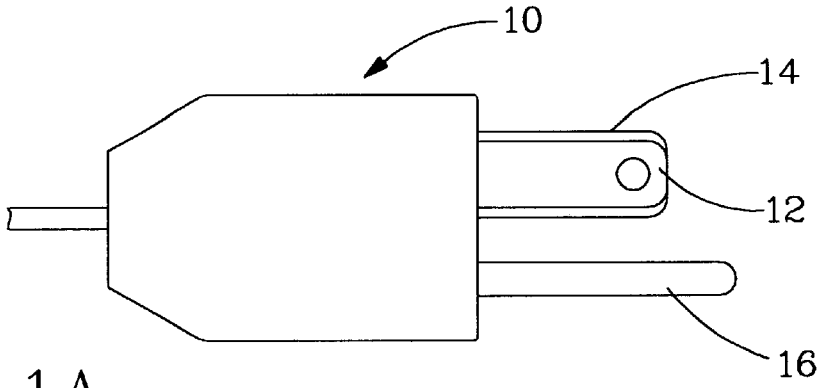
FIG. 1A (PRIOR ART)
FIG. 1A is a side view of a conventional electrical plug with a grounding pin.
Figure 1B:
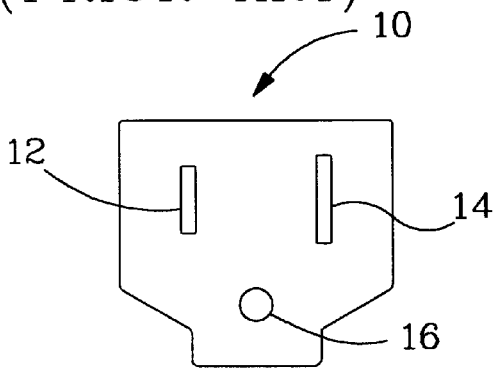
FIG. 1B (PRIOR ART)
FIG. 1B is an end view of FIG. 1A.
Figure 1C:
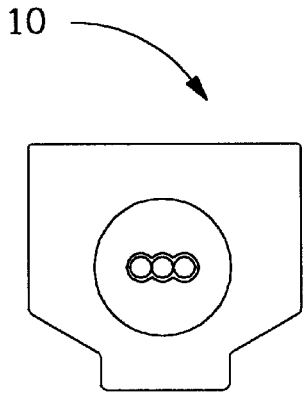
FIG. 1C (PRIOR ART)
FIG. 1C is another end view of FIG. 1A.

Turning first to FIGS. 1A, 1B, and 1C, explanation will be briefly provided of a conventional three-prong plug 10. In a known three-prong plug 10, there are at least three elements which are used in connection with a conventional outlet and with the splash protector of the present invention. Specifically, the three-prong plug 10 includes a positive prong 12 and a negative prong 14 which correspond to the positive and negative slotted openings in a conventional outlet 18 (see FIG. 7), such that insertion of the plug 10 into a corresponding outlet will complete a circuit. Additionally, many of the newer known plugs 10 include a grounding pin 16 centered below the positive and negative prongs 12, 14 on a face of the plug 10. It should be noted that the grounding pin 16 is longer than or protrudes longitudinally beyond the length of the positive and negative prongs 12, 14, as seen most clearly in FIG. 1A. The invention advantageously utilizes the length of grounding pin 16 in a manner to be described more fully hereinbelow.

Figure 2A:
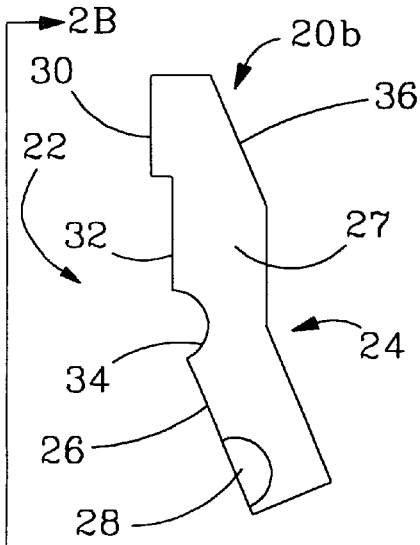
FIG. 2A is a front view of a single electrical outlet safety shield according to a first preferred embodiment of the present invention.
Figure 2B:
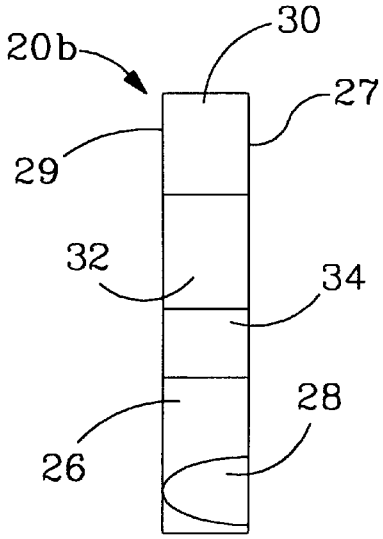
FIG. 2B is an end view of FIG. 2A.

FIG. 2A is a front view and FIG. 2B is an end view taken along line 2B—2B of FIG. 2A and showing one half of a safety shield 20 according to a preferred embodiment of the present invention. It should be understood that the safety shield 20 includes a pair of shield portions 20*a* and 20*b*. Shield portion 20*a* is a mirror image of shield portion 20*b*. Each shield portion 20*a* or 20*b* of the safety shield 20 includes an inner face 22 and an outer face 24 opposite the inner face 22. Upon assembly, the inner faces 22 of the shield portions 20*a*, 20*b* are selectively separated and joined for the purpose of exposing and shielding the openings of the electrical outlet 18 (see FIG. 7), respectively.

Each of the inner faces 22 of the shield portions 20*a*, 20*b* include a lower flat surface 26 having a tapered groove 28 formed therein and an upper flat surface 30 at an opposite end of the shield portion from the lower flat surface 26. The lower flat surface 26 is angularly offset from the upper flat surface 30 of the shield portion 20*a*, 20*b*. An inset surface 32 is set in from but formed parallel to the upper flat surface 30 of the shield portion 20*a*, 20*b*. Within the inset surface 32, there is formed a circular cutout area 34, the cutout area terminating at a transition to the lower flat surface 26 of the shield portion 20*a*, 20*b*. In further understanding of the lower flat surface 26, the tapered groove 28 is formed such that the groove 28 initiates at a top surface 27, and tapers to a termination at a bottom surface 29. At no location of the tapered groove 28 is there a cutout or opening formed which would affect the continuity of the bottom surface 29. Thus, upon joining of the lower flat surfaces 26 together, a flush mating is achieved therebetween.

The outer face 24 of each shield portion 20*a*, 20*b* is such that the surface is substantially parallel to each of the lower face 26 and the recessed surface 32, while the upper flat surface 30 is backed by an angled surface 36 on the outer face 24 of the shield portions 20*a*, 20*b*. Optionally, Angled surface 36 can be provided with a partial cut out to allow prongs 12 and 14 to move shield portions 20*a* and 20*b*. It should be noted, however, that the shape of the outer surface 24 can be varied to suit particular manufacturing, consumer, or industry needs.

Each of the shield portions 20*a*, 20*b* of the safety shield 20 is made of plastic or any dielectric material in its preferred embodiment.

Figure 3A:
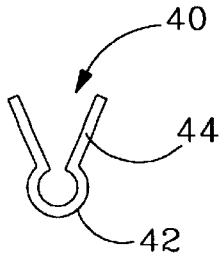
FIG. 3A is a front view of spring for use with the outlet safety shield of FIGS. 2A and 2B.
Figure 3B:
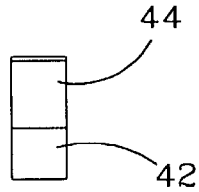
FIG. 3B is a side view of the spring shown in FIG. 3A.

Turning now to FIGS. 3A and 3B, there is shown a front view and an end view, respectively, of a spring 40 for use with the safety shield 20 of the preferred embodiment. The spring 40 includes a substantially circular base portion 42 terminating in a pair of radial arms 44. The spring 40 is normally biased outward such that the radial arms 44 are spaced apart, and a force against the radial arms 44 will compress the radial arms 44 together, to a point where they are in surface contact with each other. The central axis of the spring 40 is centered in the substantially circular base portion 42.

Upon assembly of the safety shield 20 with the spring 40, the circular portion 42 of the spring 40 is fit within the cutout area 34 of the shield portions 20*a*, 20*b* and one of each of the radial arms 44 of the spring 40 are fit within a corresponding inset surface 32 of the shield portions 20*a* and 20*b*. This assembly results in a flush surface between an inner face of the radial arms 44 and the upper flat surface 30 of the shield portions 20*a*, 20*b*.

FIG. 4 is a rear view illustrating a safety shield 20 installed in an electrical outlet 50 of the present invention and FIG. 5 is a rear view showing the safety shield 20 installed in the electrical outlet 50 with the plug 10 inserted therein. More specifically, the electrical outlet 50 includes a plastic piece having an outer dimension shown at 52 and an inner recessed portion 54. It should be noted that the inner recessed portion 54 is in fact facing to the interior of the outlet 50 and the shape thereof is not seen from an exterior of the outlet structure as viewed by a user inserting a plug 10 into the outlet 50. Accordingly, top surface 27 of shield portions 20*a* and 20*b* face the user, and bottom surfaces 29 are visible in this view. The inner recessed portion 54 is of a size to encompass positive 56 and negative 58 cutout slots of the outlet 50 as well as a cutout grounding hole 60 of the outlet. The inner recessed portion 54 of the outlet 50 also includes a support post 62 projecting therefrom. The support post 62 is located to receive the axial portion of the circular base portion 42 of the spring member 40 therearound. It is anticipated that an inner circumferential surface of the circular base portion 42 will be friction fit with an outer circumferential surface of the support post 62. However, support post 62 can also be formed with a head for retaining spring member 40. The combined safety shield 20 and spring 40 are fit within the inner recessed portion 54 of the outlet 50 so that the support post 62 of the outlet 50 is axially fit within the circular portion of the spring 40.

In FIG. 4, the normal bias of the spring 40 maintains the shield portions 20*a,* 20*b* spaced apart from each other so that a portion (the upper ends) of the shield portions 20*a,* 20*b* are completely covering the slotted prong openings 58, 60 of the outlet 50. Additionally, the normal biasing outward of the upper ends of the shield portions 20*a,* 20*b* causes the joining of the lower flat surface 26 of the shield portions 20*a,* 20*b* in a flush manner. The tapered groove 28 of the lower flat surface 26 thus has its edges aligned so that the cutout grounding hole 60 of the outlet 50 is completely covered from an interior of the outlet 50.

In FIG. 5, insertion of the conventional plug 10 causes the grounding pin 16 to slide into the tapered grooves 28 of the shield portions 20*a,* 20*b* thereby gradually separating the lower flat surfaces 26 of the shield portions 20*a,* 20*b* away from each other. Because the grounding pin 16 is longer than either of the positive prong 12 or the negative prong 14, the grounding pin 16 will lead the insertion of the plug 10 into the outlet, thereby enabling the camming of the lower flat surfaces 26 of the shield portions 20*a,* 20*b* away from each other. The tapered grooves 28 of the lower flat surfaces 26 permit an easy sliding of the grounding pin 16 thereagainst, and eventually separates the lower flat surfaces 26 of the shield portions 20*a,* 20*b* away from each other. Upon separation of the lower flat surfaces 26 of the shield portions 20*a,* 20*b*the radial arms 44 of the normally biased spring 40 are compressed together by the action of the shield portions 20*a,* 20*b* until the upper flat surfaces 30 of the shield portions 20*a,* 20*b* are flush against each other. Upon complete compression of the radial arms 44 of the spring 40, the slotted prong openings 56, 58 of the outlet 50 are exposed, allowing for insertion of the positive and negative prongs 12, 14 into the corresponding outlet openings 56, 58, respectively. The plug 10 may be fully inserted so that there are no exposed prongs 12, 14 or grounding pin 16.

Figure 6A:
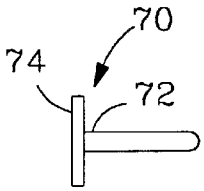
FIG. 6A is a side view of an override pin according to a second preferred embodiment of the present invention.
Figure 6B:
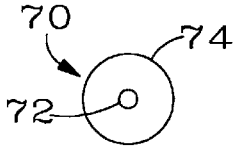
FIG. 6B is an end view of an override pin of FIG. 6A.

Referring now to FIGS. 6A and 6B, if the plug 10 to be inserted into the outlet 50 has no grounding pin 16, then it will be necessary to insert an override pin 70 into the grounding hole 60 and thus against the tapered groove 28 of the shield portions 20*a,* 20*b*. The override pin 70, similar to the grounding pin 16, cams the shield portions 20*a,* 20*b* so that insertion of an ungrounded plug can be effected. This insertion of the override pin 70 should only be performed just prior to installing a plug without a grounding pin 16. Under these conditions, it will be necessary to manually remove override pin 70 when the ungrounded plug is removed in order to return the outlet to its safety configuration.

In detail, the override pin 70 includes an elongated shaft portion 72 and a head 74 at one end of the elongated shaft portion 72. The diameter and length of the shaft 72 of the override pin 70 is similar to the diameter and length of the grounding pin 16 of the electrical plug 10. In addition, override pin 70 has an enlarged head member 74 which will prevent the shaft 72 from completely entering the grounding hole 60 of the outlet 50 when it is inserted therein. The head portion 74 also provides an area which can be grasped to remove the override pin 70 from the outlet 50. However, it should be noted that the thickness of the head portion 74 is thin enough to prevent any interference with insertion of a plug having no grounding pin 16. Generally, the override pin 70 will be formed as a one-piece construction and out of a non-conductive material to avoid shock or injury to the user. However, the override pin 70 may be formed, as necessary, of a two-piece construction or with rubber coating or the like on the head portion 74 for safety purposes.

Figure 7:
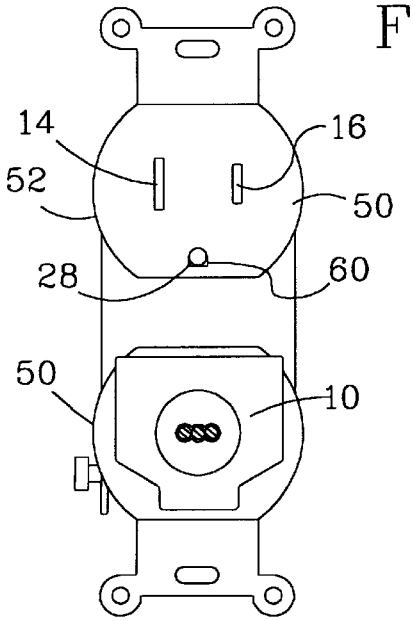
FIG. 7 is a front view of an electrical receptacle with an electrical plug installed in the lower outlet.

The fully assembled electrical outlet with a splash protector and having an electrical plug inserted in the lower outlet thereof is shown in FIG. 7. The outward appearance of outlet 50 is almost identical to standard receptacles which are presently widely known. The only outwardly physical difference between the appearance of the safety outlet 50 a standard receptacle is that the rectangular slots 56, 58 and grounding hole 60 will be completely blocked by shield portions 20*a,* 20*b* and the joined edges of the tapered groove portion 28 will be visible through the grounding hole 60 in the outlet 50. The plastic outlet 50 will be riveted to a back plastic piece in the same manner as is presently common practice. In addition, the terminal connections and foundation mounts will be unchanged from the existing, well known configuration. As a result of this similarity, the safety receptacle 50 will be interchangeable for replacement of receptacles which are already installed or suitable for new installation into existing configuration electrical boxes and be able to utilize existing face plates.

In summary, a preferred embodiment of the present invention illustrates shield portions 20*a,* 20*b* confined just behind the front face of an electrical outlet 50. These shield portions 20*a,* 20*b* are positioned by the single spring 40 which places them so that they completely block access through the rectangular prong slots 56, 58 and circular grounding hole 60 of the outlet 50. However, when the grounding pin 16 of a standard plug 10 is inserted in the outlet's grounding hole 60, it automatically cams the shield portions 20*a,* 20*b* out of the way so that the rectangular slots 56, 58 in the outlet 50 are opened for insertion of the rectangular prongs 12, 14 of a standard electrical plug 10. If the plug 10 does not have a grounding pin 16, then the override pin 70 is provided to cam the shield portions 20*a,* 20*b* out of the way.

The present invention is inexpensive and may be incorporated into the basic configuration of a standard electrical outlet such that the safety shield mechanically prevents the splashing of water or other liquids into the rectangular slots. The safety shield therefore prevents the potential for shorting of electrical power or the corrosion of internal components of an outlet.

When the subject matter of the present invention is incorporated into the design of an electrical outlet, it will result in a splash protection receptacle which is interchangeable with conventional receptacles and completely compatible with existing electrical boxes, face plates, foundation and wiring.

The subject matter of the present invention can be mass produced without a significant increase in cost over a standard electrical outlet configuration.

The configuration shown provides the basic concept only, and may be modified as necessary as to the size and shape of the components described.

By the present invention, a safety shield for an electrical outlet is provided in a more efficient manner than previously achieved in the art.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A splash protector for use in an electrical outlet comprising:

a shield member including a first shield portion and a second shield portion opposite to the first shield portion, each shield portion including an inner side and an outer side opposite to the inner side, the inner side including a lower flat surface having a tapered groove formed therein terminating in a flush edge with the lower flat surface, an upper flat surface, and an inset area parallel to and set in from the upper flat surface and having a cutout portion formed in the face thereof, the lower flat surface being angularly positioned with respect to the inset area; and a spring member including a substantially circular base portion with an inner surface and an outer peripheral surface, the circular base portion terminating in a pair of radial arms extending outward from said circular base portion, the radial arms of said spring member having an inner surface and an outer surface, the inner surfaces being normally biased apart;

wherein said spring member fits within facing inner sides of the first and second shield portions such that the outer periphery of the circular base portion seats within the cutout portions and the outer surfaces of the radial arms seat within the inset areas of said first and second shield portions.

2. The splash protector according to claim 1 wherein the cutout portion of the shield portions is immediately adjacent to the lower flat surface.

3. The splash protector according to claim 1 wherein the lower flat surface is angularly offset by less than 45 degrees from the inset area.

4. The splash protector according to claim 1 wherein said first and second shield portions are formed of a non-conductive material.

5. The splash protector according to claim 1 wherein said spring member is formed of a non-conductive material.

6. A splash protector in combination with an electrical outlet comprising:

a shield member including a first shield portion and a second shield portion opposite to the first shield portion, each shield portion including an inner side and an outer side opposite to the inner side, the inner side including a lower flat surface having a tapered groove formed therein terminating in a flush edge with the lower flat surface, an upper flat surface, and an inset area parallel to and set in from the upper flat surface and having a cutout portion formed in the face thereof, the lower flat surface being angularly positioned with respect to the inset area;

a spring member including a substantially circular base portion with an inner surface and an outer peripheral surface, the circular base portion terminating in a pair of radial arms extending outward from said circular base portion, the radial arms of said spring member having an inner surface and an outer surface, the inner surfaces being normally biased apart;

an outlet cover having an outer face with a pair of rectangular plug slots and a grounding hole formed therein, and an inner face having a recessed area formed therein with an outer perimeter of the recessed area encompassing at least the pair of rectangular slots and grounding hole, but less than an outer dimension of said outlet cover; and a post positioned on the inner face of said outlet cover within the recessed area and projecting therefrom;

wherein said spring member fits within facing inner sides of the first and second shield portions, the inner surface of the circular base portion fits over said post and the outer peripheral surface of the circular base portion seats within the cutout portions, the outer surface of the radial arms seat within the inset areas of said first and second shield portions, the outer surface of said shield portions abut against the inner periphery of the recessed area of the outlet when said spring is in the normally biased position, thereby completely blocking external access to the rectangular slots of said outlet cover, and the lower flat surfaces of the first and second shield portions abut against one another when said spring is in the normally biased position thereby completely blocking external access to the grounding hole of said outlet cover.

7. The splash protector of claim 6 further comprising means for selectively camming the upper flat faces of the shield portions against each other, thereby enabling external access to the rectangular slots of said outlet cover.

8. The splash protector according to claim 7 wherein said means for camming is a grounding pin of an electrical plug applied against the tapered groove of said shield portions.

9. The splash protector according to claim 7 wherein said means for camming is an override pin applied against the tapered groove of said shield portions.

10. The splash protector according to claim 6 wherein the cutout portion of the shield portions is immediately adjacent to the lower flat surface.

11. The splash protector according to claim 6 wherein the lower flat surface is angularly offset by less than 45 degrees from the inset area.

12. The splash protector according to claim 6 wherein said first and second shield portions are formed of a non-conductive material.

13. The splash protector according to claim 6 wherein said spring member is formed of a non-conductive material.

14. The splash protector according to claim 6 wherein said post is of a height to accommodate a corresponding dimension of the circular base portion of said spring.

15. The splash protector according to claim 6 wherein said post is of a circumference to accommodate a friction fit with the inner circumference of the circular base portion of said spring.

16. The splash protector according to claim 6 wherein said post has a head formed thereon for retaining the circular base portion of said spring.

* * * * *